US005766094A

United States Patent [19]

Mahaffey et al.

[11] Patent Number: 5,766,094

[45] Date of Patent: Jun. 16, 1998

[54] FACE INSERTS FOR GOLF CLUB HEADS

[75] Inventors: Steve J. Mahaffey, Hampden, Mass.; Daniel Melanson, Avon, Conn.

[73] Assignee: Lisco Inc., Tampa, Fla.

[21] Appl. No.: 660,252

[22] Filed: Jun. 7, 1996

[51] Int. Cl.[6] ..... H63B 53/04

[52] U.S. Cl. ..... 473/342; 473/345; 473/347; 473/349

[58] Field of Search ..... 473/342, 345, 473/324, 347, 349, 350

[56] References Cited

U.S. PATENT DOCUMENTS

| | | | |
|---|---|---|---|
| 3,695,618 | 10/1972 | Woolley et al. . | |
| 4,085,934 | 4/1978 | Churchward . | |
| 4,630,826 | 12/1986 | Nishigaki et al. . | |
| 4,681,322 | 7/1987 | Straza et al. | 473/342 X |
| 4,754,975 | 7/1988 | Aizawa . | |
| 5,078,397 | 1/1992 | Aizawa . | |
| 5,221,087 | 6/1993 | Fenton et al. | 473/342 |
| 5,301,941 | 4/1994 | Allen . | |
| 5,346,213 | 9/1994 | Yamada | 473/342 X |
| 5,362,055 | 11/1994 | Rennie | 473/342 |
| 5,377,986 | 1/1995 | Viollaz et al. . | |
| 5,405,137 | 4/1995 | Vincent et al. . | |
| 5,586,948 | 12/1996 | Mick | 473/342 X |

*Primary Examiner*—Raleigh W. Chiu
*Attorney, Agent, or Firm*—Donald R. Bahr; Laubscher & Laubscher

[57] ABSTRACT

A golf club head including a striking face comprising a recessed area in the striking face and an insert secured in the recessed area. The insert has at least one cavity therein with the cavity terminating short of the outer striking face.

10 Claims, 3 Drawing Sheets

FIG. 7
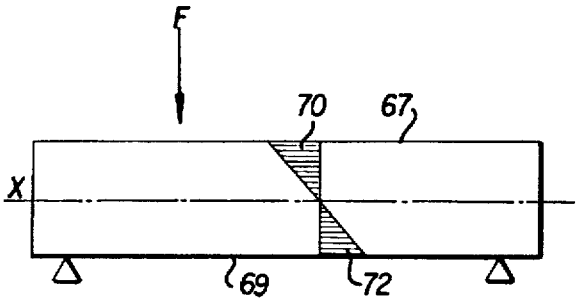
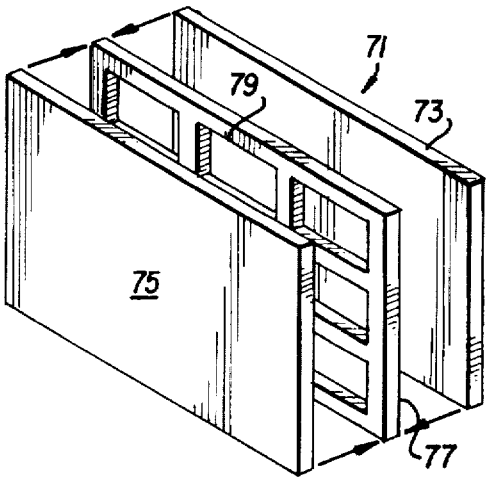
FIG. 8
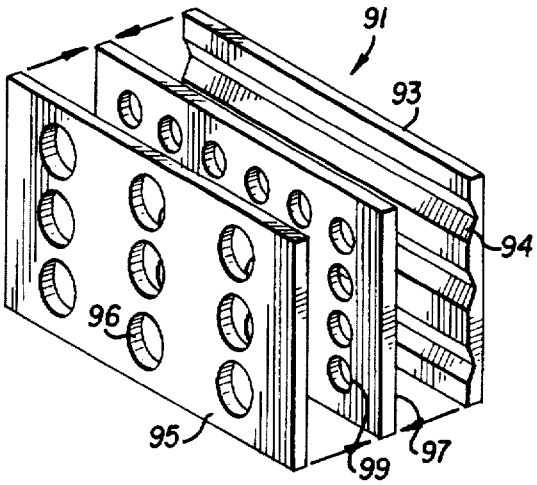
FIG. 9
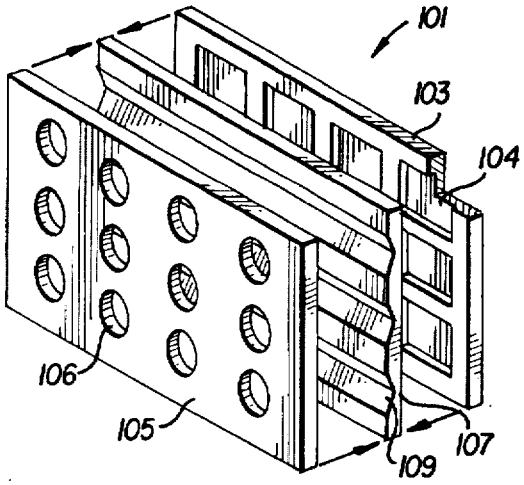
FIG. 10

FIG. 11
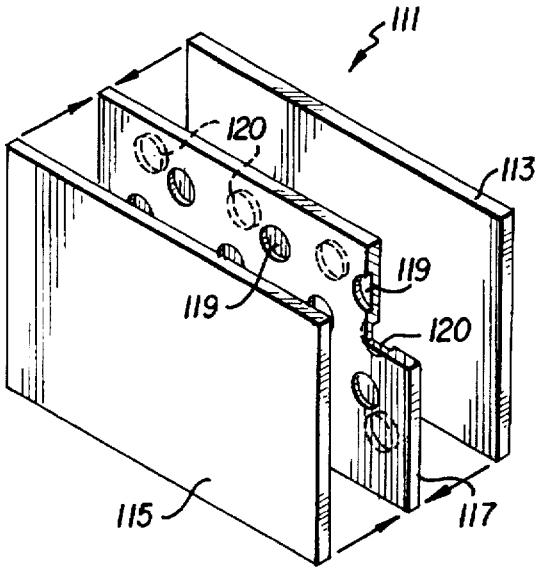
FIG. 12
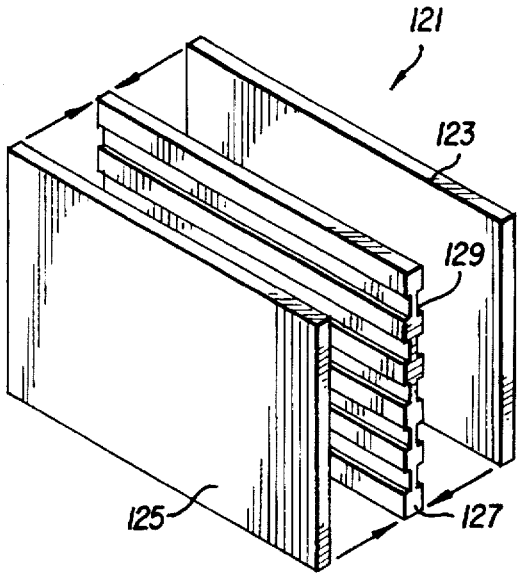
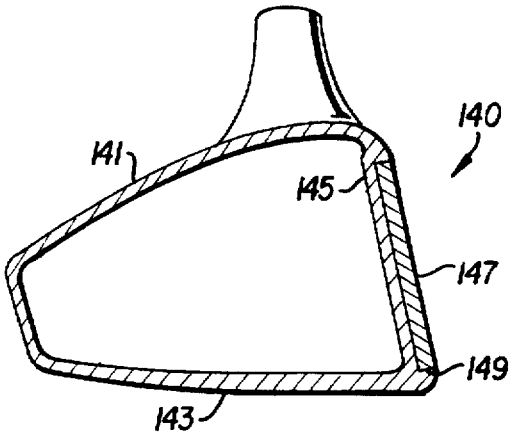
FIG. 13
FIG. 14
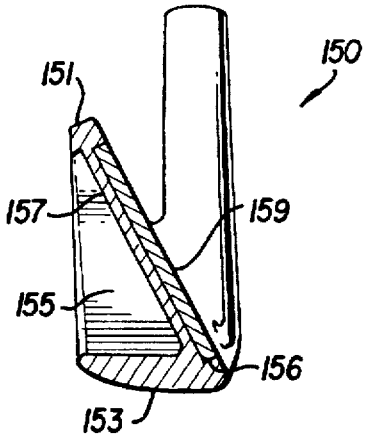

FACE INSERTS FOR GOLF CLUB HEADS

This invention relates generally to golf club heads and more specifically to golf club heads which have inserts in the striking face.

Golf clubs are designated primarily in separate categories of woods, irons, and putters. The majority of golf club woods at the present time are made of some metal or composition, while most irons are made of varying types of metal. Woods can be constructed of solid metal or can be constructed so as to have recesses in which a face or insert is placed in the striking surface. While most irons are made of metal, some also have recesses for accepting inserts in the striking face.

It is recognized that advantages are provided by redistributing the weight of golf clubs in both woods and irons so that an increase in the weight around the perimeter of the head enhances the moment of inertia, which increases head stability, which in turn lessens head rotation that imparts side spin on the ball. This creates either a hook or slice (which is the same as a gear effect) through impact on off-center hits.

The present invention discloses various modifications of inserts which are designed to provide this highly desirable weight distribution.

Further, the present invention discloses various modifications of inserts so configured that part of the weight of the insert used can be redistributed to the perimeter of the head so as to increase the moment of the head.

These and other objects will become apparent from the following description taken together with the drawings.

SUMMARY OF THE INVENTION

The present invention provides golf club heads, both woods and irons, with recessed areas in the striking faces of the club heads and an insert secured within the recessed areas. The insert has at least one cavity therein, with the cavity terminating short of the outer striking face. The insert can be made from a cast, formed or extruded material and may be of one-piece or laminated construction.

BRIEF DESCRIPTION OF THE DRAWINGS

FIG. 7 is a schematic illustration of the principle of the present invention;

FIGS. 8–12 are exploded views of further embodiments of the present invention;

FIG. 13 is a cross-sectional view of a further embodiment of a metal wood used in the present invention; and FIG. 14 is a cross-sectional view of a further embodiment of a metal iron used in the present invention.

DETAILED DESCRIPTION OF THE PREFERRED EMBODIMENTS

Figure 1:
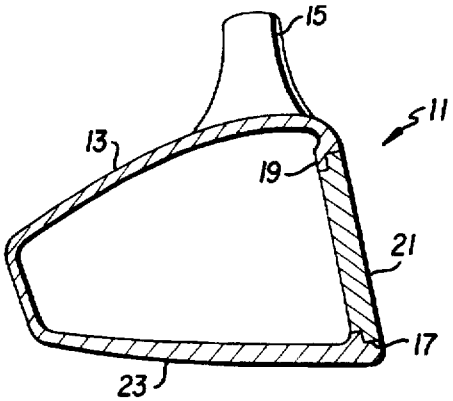
FIG. 1 is a cross-sectional view of one embodiment of a metal wood used in the present invention.

FIG. 1 shows metal wood 1 1 having crown 13, hosel 15, and sole 23, with face support structure 19 having recess 17 therein. In this particular configuration, the recess includes a lip surrounding the interior of the recess. Insert 21 is configured so as to fit within the recess and be secured therein adjacent the lip. This is commonly referred to as an unsupported insert since the club head does not have a complete surface backing adjacent the major portion of the insert.

Figure 2:
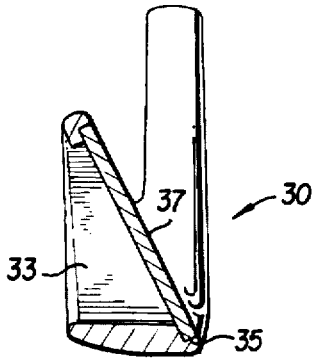
FIG. 2 is a cross-sectional view of one embodiment of a metal iron used in the present invention.

FIG. 2 shows iron 30 having sole 31, cavity 33, and recess 35. Again, this recess has a lip against which insert 37 is placed and secured thereto. This also provides an iron with an unsupported face insert.

All of the inserts discussed below are specifically designed so as to increase the strength of the insert while reducing the weight of the golf club face hitting area, thereby creating a higher club head inertia, a more efficient striking surface, and a larger sweet spot. Additionally, the reduced weight of the club face can be added to the perimeter of the club head to provide favorable weight distribution. It is to be understood that the material used in the inserts could be any metal or composite that would be formed extruded, cast, or forged to provide the favorable weight distribution of the golf club head as discussed above.

It is also to be noted that while individual examples will be discussed, the invention relates to an insert specifically designed with various geometric cavities to form a solid or bonded insert which would significantly increase strength while reducing the weight of the golf club face hitting area.

Further, the inserts are designed with differing geometric configurations to produce a strong face wall to resist collapsing while reducing overall insert weight by a significant amount. This increases overall club head peripheral weight, thereby increasing the club head's overall performance.

While some of the inserts discussed below are of a laminate structure, such structure is not specifically shown in FIGS. 1 and 2 for purposes of clarity.

Figure 3:
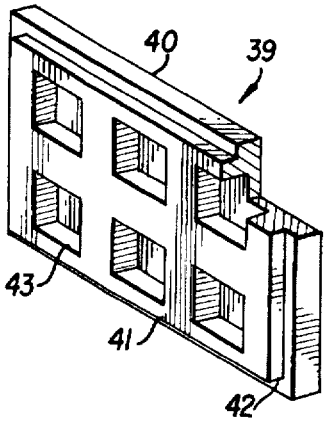
FIG. 3 is a partial cross-sectional view of one embodiment of an insert used in the present invention.

Referring to FIG. 3, insert 39 is cast, formed, or forged of metal having front face 40, rear face 41, and a peripheral undercut section 42 which fits within the recess of club head 11 of FIG. 1. It is to be understood that all of the inserts discussed below could include such an undercut section if desired.

In order to reduce the weight of the insert of FIG. 3 for the purposes discussed above, a plurality of cavities 43 extend inwardly from rear surface 41 and terminate short of striking face 40.

Figure 4:
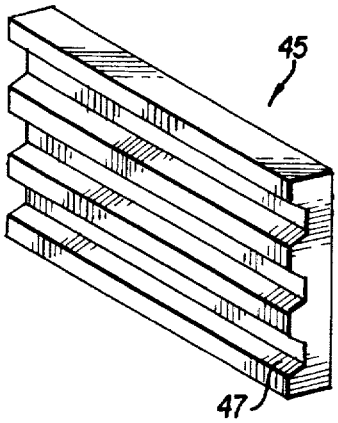
FIG. 4, 5, and 6 are perspective views of further embodiments of inserts which may be used in the present invention.

Referring to FIG. 4, there is shown a cast, formed, or forged insert 45 wherein the weight reduction is provided by a plurality of longitudinal cavities 47 extending across the insert.

Figure 5:
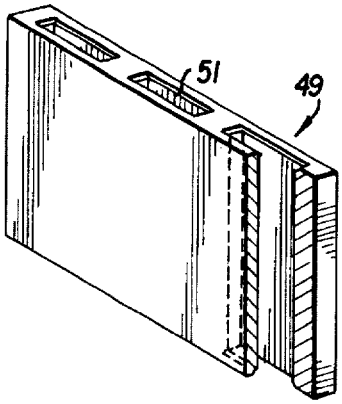

FIG. 5 discloses insert 49. Insert 49 is extruded so as to include cavities 51 extending vertically from the top to the bottom within the insert.

Figure 6:
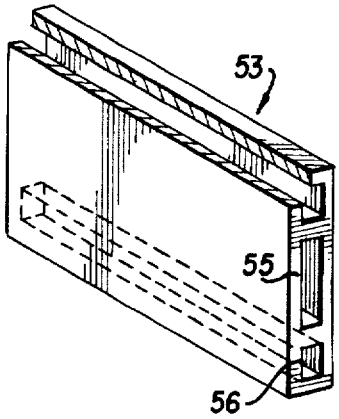

FIG. 6 shows a further embodiment wherein insert 53 includes substantially horizontal cavities 55,56 which extend within the insert.

FIG. 7 is a schematic illustration of the principle of the present invention. The insert of the present invention is similar to beam or bridge theory. During impact, force F causes face 67 to flex rearwardly as it exerts force on the ball in the forward direction opposite force F. This insert acts as a beam or a bridge. For a regular insert of one material and thickness, when the face flexes rearwardly its outer surface is in compression and also withstands the highest stress levels. These forces are shown in section 71. Rearward surface 69 is in tension equal to and opposite the face compression, with tension being illustrated in section 72 of the illustration of FIG. 7.

All the sections between the outer surfaces are in varying degrees of tension and compression in relation to the axis X of the moment of inertia shown in the cross section. At axis X, the stress is 0.

With the design of the present insert, since the center axis X sees relatively low bending stresses, as much weight as possible is removed from that center section without degrading the structure to the point where failure will occur. In an ideal design situation, construction of the insert would match the maximum stress for the material with its relation to the axis of the moment of inertia of the insert. As set forth above, this permits the positioning of the removed weight of the insert about the periphery of the club head.

In FIG. 8, insert 71 includes front face 73 and rear face 75, both of which may be of a metal such as titanium, steel, or aluminum. Center laminate 77 may be of graphite, aluminum, or plastic, with the weight further being reduced by having cavities 79 therein.

In FIG. 9, insert 91 includes front face 93 of metal with longitudinal cavities 94 on the inside surface of face 93 for reducing the weight of that layer. Rear face 95 is preferably made of metal and has cavities in the form of circular holes 96 therein to reduce the weight of that layer. Center layer 97 is a material which is preferably lightweight. However, heavier material such as metal may be used with the weight reduction being provided by cavities 99.

In FIG. 10, insert 101 includes front striking face 103 comprised of a metal material having cavities 104 in rear side. Rear face 105 is also of a metal material and has cavities 106 of substantially circular holes. Central layer 107 is of a material which is lightweight again, further reduction of weight may be provided by cavities 109.

In FIG. 11, insert 111 includes front face I 13 and rear face 115, both of which are a metal such as titanium, steel, or aluminum. Center laminate 117 may be made of a lightweight metal which is further reduced in weight by creating cavities 119 and 120 on either side thereof In this embodiment, cavities 119 and 120 take the form of dimples on either side of laminate 117.

FIG. 12 is similar to FIG. 11 in that insert 121 includes front face 123 and rear face 125. Cavities 129 in center laminate 127 take the form of horizontal channels 129 on either side of the laminate.

FIG. 13 shows metal wood 140 having crown 141, sole 143, and recess 149 in the face, with the recess terminating in thin plate member 145 at the interior of the club head. Plate member 145 preferably has a thickness between 0.030 inches and 0.120 inches. Insert 147 is secured within the recess and abuts against plate 145.

FIG. 14 shows iron 150 having sole 153, upper ridge 151, and cavity 155, with recess 156 being backed by thin plate 157. Plate 157 is of a thickness between 0.030 inches and 0.120 inches. In this type of iron, insert 159 is secured within the recess and abuts against plate 157.

It is to be understood that the above specific configurations are illustrative only since various geometric shapes and cavities could be used to obtain the desired weight reduction of the present invention. Accordingly, the invention is to be limited only by the scope of the following claims.

We claim:

1. A golf club head including a striking face, said striking face comprising a recessed area in said striking face;

an insert secured within said recessed area, said insert having an outer face and an inner face, said outer face of said insert being substantially flush with the non-recessed area of said striking face; and at least one cavity arranged within said insert between said inner and outer faces, said cavity terminating short of said inner and outer faces.

2. The golf club head of claim 1 further including a plurality of cavities within said insert so as to reduce the weight of said insert.

3. The golf club head of claim 2 wherein said cavities extend substantially vertically in said insert.

4. The golf club head of claim 2 wherein said cavities extend substantially horizontally in said insert.

5. The golf club head of claim 1 wherein said insert is a multi-layer laminate.

6. The golf club head of claim 1 wherein said golf club head is metal or composite wood.

7. The golf club head of claim 1 wherein said golf club head is an iron.

8. The golf club of claim 1 wherein said golf club head further comprises an integral plate member at the rear of and adjacent to said insert.

9. A golf club head including a striking face, said striking face comprising (a) a recessed area in said striking face;

(b) a multi-layer laminated insert secured within said recessed area, said insert including (1) a front face layer having an outer face substantially flush with the non-recessed area of said striking face and containing a plurality of cavities in the surface opposite said outer face and terminating short of said outer face;

(2) a middle layer; and (3) an inner layer containing a plurality of cavities.

10. A golf club head including a striking face, said striking face comprising (a) a recessed area in said striking face;

(b) a three layer laminated insert secured within said recessed area, said insert including (1) a outer face layer having an outer face substantially flush with the non-recessed area of said striking face;

(2) a central layer containing at least one cavity; and (3) an inner face layer.

* * * * *